US009518745B2

(12) United States Patent
Boubeddi et al.

(10) Patent No.: US 9,518,745 B2
(45) Date of Patent: Dec. 13, 2016

(54) OVEN TEMPERATURE CONTROL SYSTEM

(71) Applicant: RICHARDS CORPORATION, Sterling, VA (US)

(72) Inventors: Abdelaziz Boubeddi, Ashburn, VA (US); Michael R. La Beach, Fairfax, VA (US); Paul Robinson, Front Royal, VA (US)

(73) Assignee: Richards Corporation, Sterling, VA (US)

( * ) Notice: Subject to any disclaimer, the term of this patent is extended or adjusted under 35 U.S.C. 154(b) by 266 days.

(21) Appl. No.: 14/094,896

(22) Filed: Dec. 3, 2013

(65) Prior Publication Data

US 2014/0151358 A1 Jun. 5, 2014

Related U.S. Application Data

(60) Provisional application No. 61/733,257, filed on Dec. 4, 2012.

(51) Int. Cl.
*F24C 7/08* (2006.01)
*H05B 1/02* (2006.01)

(52) U.S. Cl.
CPC ..... *F24C 7/088* (2013.01); *F24C 7/085* (2013.01); *F24C 7/087* (2013.01); *H05B 1/0263* (2013.01)

(58) Field of Classification Search
None
See application file for complete search history.

(56) References Cited

U.S. PATENT DOCUMENTS

| | | | | | |
|---|---|---|---|---|---|
| 4,623,780 | A * | 11/1986 | Shelton | 219/401 |
| 4,782,445 | A * | 11/1988 | Pasquini | 700/90 |
| 4,812,622 | A * | 3/1989 | Takeda et al. | 219/400 |
| 5,723,846 | A * | 3/1998 | Koether et al. | 219/497 |
| 6,060,701 | A * | 5/2000 | McKee et al. | 219/681 |
| 7,766,003 | B2 * | 8/2010 | Kim et al. | 126/21 A |
| 8,217,316 | B2 * | 7/2012 | Hansen et al. | 219/406 |
| 2004/0200825 | A1 * | 10/2004 | Ahuja | 219/446.1 |
| 2010/0270293 | A1 * | 10/2010 | McNamee et al. | 219/725 |
| 2010/0282097 | A1 * | 11/2010 | Schulte | 99/476 |

FOREIGN PATENT DOCUMENTS

| | | |
|---|---|---|
| EP | 0272602 A2 | 6/1998 |
| WO | 97/03538 A1 | 1/1997 |

OTHER PUBLICATIONS

International Patent Application No. PCT/US2013/072727, International Preliminary Report on Patentability dated Jun. 18, 2015.
PCT/US2013/072727, International Search Report and Written Opinion dated Apr. 16, 2014, 9 pages.

* cited by examiner

*Primary Examiner* — Joseph M Pelham
(74) *Attorney, Agent, or Firm* — Kilpatrick Townsend & Stockton LLP; Dean W. Russell; Kristin M. Crall

(57) ABSTRACT

Embodiments of the present disclosure relate generally to a system that improves heat distribution throughout an internal cooking cavity of an oven. The embodiments described may find particular use in ovens used on-board passenger transport vehicles, but they may also be incorporated into other ovens, such as residential and other commercial ovens.

5 Claims, 3 Drawing Sheets

OVEN TEMPERATURE CONTROL SYSTEM

CROSS REFERENCE TO RELATED APPLICATIONS

This application claims the benefit of U.S. Provisional Application Ser. No. 61/733,257, filed Dec. 4, 2012, titled "Temperature Control System," the entire contents of which are hereby incorporated by reference.

FIELD OF THE DISCLOSURE

Embodiments of the present disclosure relate generally to a system that improves heat distribution throughout an internal cooking cavity of an oven. The embodiments described may find particular use in ovens used on-board passenger transport vehicles, but they may also be incorporated into other ovens, such as residential and other commercial ovens.

BACKGROUND

Currently, cooking cavity temperatures are monitored by a temperature sensor that is located at the back of the cavity. Typically, this sensor is located behind the baffle plate that separates the meals that are contained inside the cavity from the oven's hardware, such as the heating elements and the blower wheel. The temperature sensor is designed to turn the heating elements on and off, depending upon the temperature of the cooking cavity. This can be referred to as "cycling" of the oven.

The baffle plate is designed to control air distribution in the cooking cavity. It may have an opening in the middle that pulls in air from the cooking cavity. Heated air can then be allowed to travel around sides of the baffle plate, back to the cooking cavity in order to create an air loop.

In one aspect, the temperature sensor can be programmed to prompt the heaters to switch off at a pre-set temperature. Because the rear of the oven (which is where the sensor and the heating elements are located) will heat more quickly than the interior of the cooking cavity, this pre-set temperature is generally lower than the temperature of the rest of the cooking cavity. This means that shutting off the heating elements at the pre-set temperature results in uneven temperatures throughout the cooking cavity. The ambient temperature behind the baffle plate does not reflect the ambient temperature in the rest of the cooking cavity, as the temperature in this area may be considerably higher than the rest of the cooking cavity. In this scenario, the temperatures at the front of the cooking cavity are lower than the temperatures at the back of the cooking cavity. This can result in large variations of meal temperatures, longer cooking times, and variations in meal quality.

BRIEF SUMMARY

Embodiments described herein thus provide a system to measure the temperature at various locations in the cooking cavity and to adjust the temperature at which the heating elements turn on and off. Embodiments of this disclosure seek to improve the temperature variations in meals by creating a more uniform cooking cavity temperature for the duration of the cooking cycle. Multiple temperature sensors are provided in order to determine an average oven temperature from points measured at multiple areas of the cooking cavity.

DETAILED DESCRIPTION

Ovens for use on board aircraft are generally used to re-heat meals. According to aircraft regulations, the meals should be heated to a minimum temperature, generally above about 70° C. In order to comply with this requirement, aircraft ovens may need to run longer than necessary in order to have all meals heated to this temperature. One problem this creates is that some meals will be heated to temperatures that are higher than desired, which can result in meal degradation. Similar situations can occur with other residential and commercial ovens.

Figure 1:
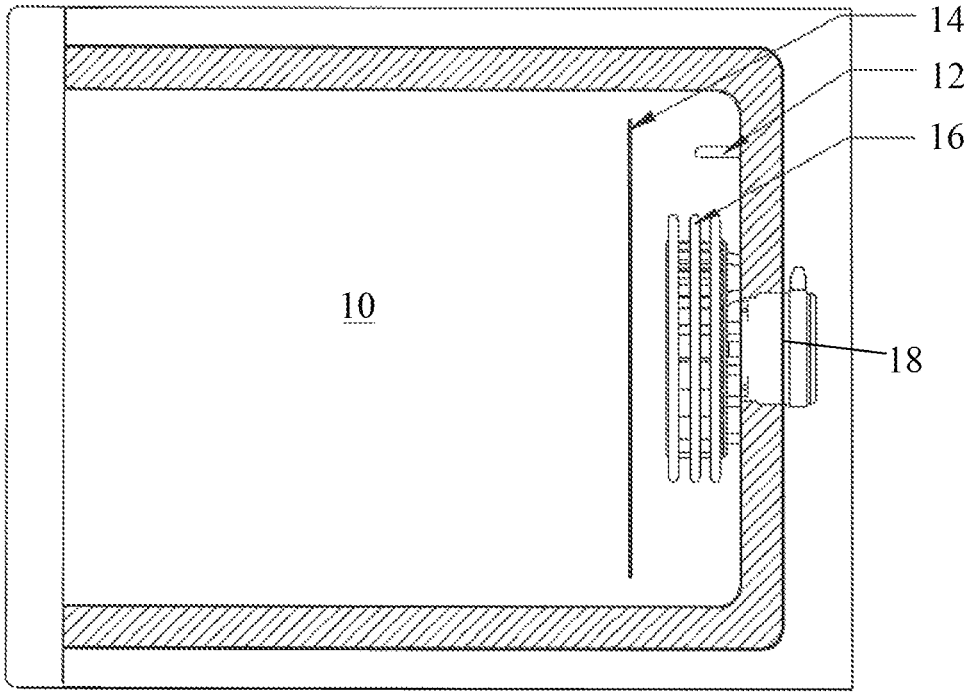
FIG. 1 shows a side schematic view of a cooking cavity with a rear temperature sensor.

As shown in FIG. 1, the temperature of a cooking cavity 10 is measured by a temperature sensor 12 that is positioned in the cooking cavity 10 behind a baffle plate 14. This sensor may be referred to herein as a rear temperature sensor 12. The rear temperature sensor 12 is provided to measure the temperature of an area around the oven hardware, such as the one or more heating elements 16 and the motor 18. If this area is allowed to rise above a specified temperature, damage to the hardware can occur. Accordingly, the rear temperature sensor 12 is generally set to shut off at a pre-set value. In the examples that follow, the pre-set valve will be described as 200° F., but this value is used for exemplary purposes only. The pre-set value may be set dependent upon the heat resistance of the hardware and any applicable regulations.

If the pre-set value is 200° F., and the rear temperature sensor 12 senses a 200° F. temperature in the sensing area, it will trigger a control system to turn off the heating element(s) 16. However, when the temperature in the sensing area behind the baffle plate 14 is 200° F., it is likely that the area of the cooking cavity 10 in front of the baffle plate 14 is not that high. Variations of up to several degrees can occur.

Figure 2:
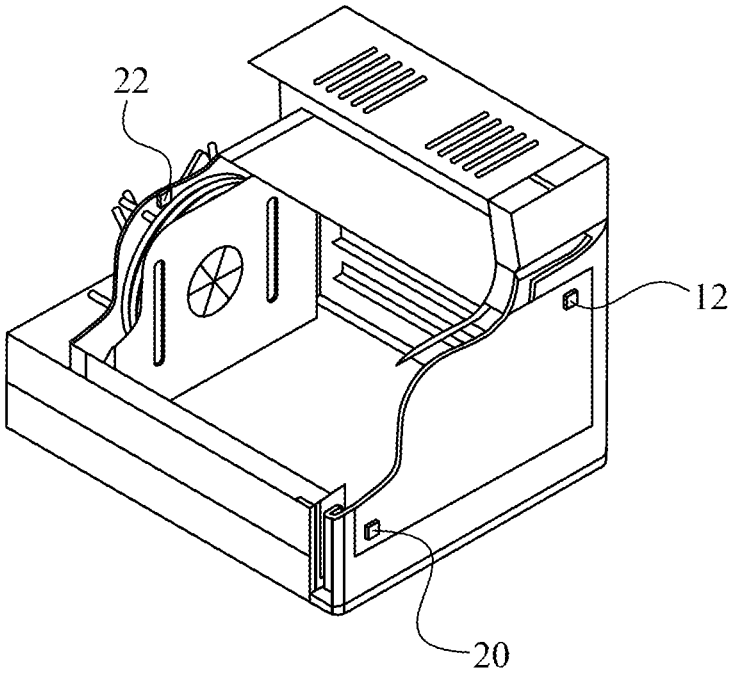
FIG. 2 top perspective view of an improved cooking cavity having multiple temperature sensors.

Accordingly, the present disclosure provides one or more front temperature sensors 20, 22 at areas in the cooking cavity 10 in front of the baffle plate 14. One example is shown in FIG. 2. In one embodiment, a single temperature sensor 20 may be provided. In other embodiments, two temperature sensors 20, 22 may be provided. In other embodiments, further temperature sensors may be provided at other areas of the cavity 10. The purpose of the one or more front temperature sensors is to measure the temperature at the surrounding areas in front of the baffle plate 14. This sensor (or these sensors) will sense the true temperature in the cooking cavity 10. As shown in FIG. 2, a first temperature sensor 20 may be located at a front side of the cavity 10. A second temperature sensor 22 may be located at a side wall of the cavity 10. They may be positioned diagonally from one another, both at the front, both at the sides, at an upper portion of the cavity, at a lower portion of the cavity, or at any other appropriate location for optimal temperature sensing.

The value recorded by the rear temperature sensor 12 can be combined with the value recorded by the one or more front temperature sensors 20, 22 in order to determine an optimal shut off point for the heating element(s) 16. This combination may be run by an algorithm or formula that will account for various variables, including optimal cooking temperature and an optimal working temperature for the hardware. Thus, rather than shutting off at a pre-set value, the heating elements 16 can be allowed to continue to heat until a more optimal temperature in the cooking cavity 10 has been reached, based on information obtained from various data points in the cooking cavity 10.

Figure 3:
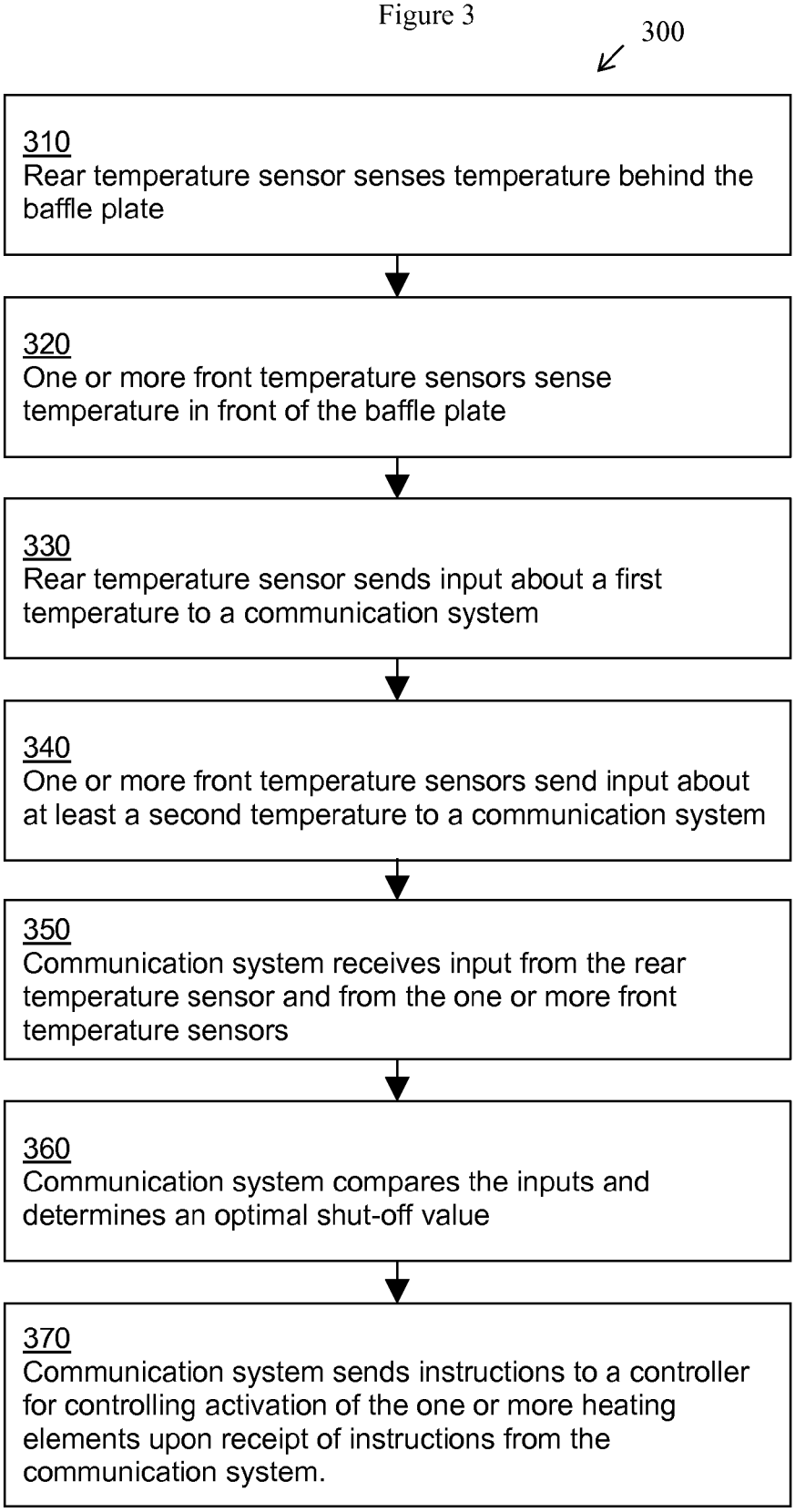
FIG. 3 is a flowchart illustrating the signals communicated between various elements of the cooking cavity.

In one method 300 as illustrated in the flowchart of FIG. 3, the rear temperature sensor 12 senses the temperature behind the baffle plate 14, as depicted in 310. The one or more front temperature sensors 20, 22 sense temperature in front of the baffle plate 14, as depicted in 320. The rear temperature sensor 12 sends input about the sensed temperature value to a communication system, as depicted in 330. The one or more front temperature sensors also send input about the sensed temperature value to a communication system, as depicted in 340. As depicted in 350, the communication system receives input from both the rear temperature sensor 12 and the one or more front temperature sensors 20, 22. The communication system then compares the inputs and determines an optimal shut-off value, as depicted in 360. The communication system sends instructions to a controller for controlling the activation of the one or more heating elements upon receipt of instructions from the communication system, as depicted in 370.

In short, temperature data and/or measured variable(s) from the one or more front temperature sensors 20, 22 will be combined with temperature data and/or measured variable(s) from the rear temperature sensor 12 in order to determine an optimal temperature value, rather than simply using an automatic pre-set value. The communication system can run an algorithm designed to optimize the temperature and the point at which the heating elements should be cycled (i.e., turned on and/or off). The controller then implements the instructions from the communication system. The controller and the communication system may be designed to be integral with the oven, such that they are components installed with or near the oven. In other embodiments, the controller and the communication system may be designed to be remote from the oven, such that they compute and control at a distance away from the oven and relay instructions back to the oven. They may be connected with a wired connection or a wireless connection, either to one another and/or to the oven cooking cavity.

Figure 4:
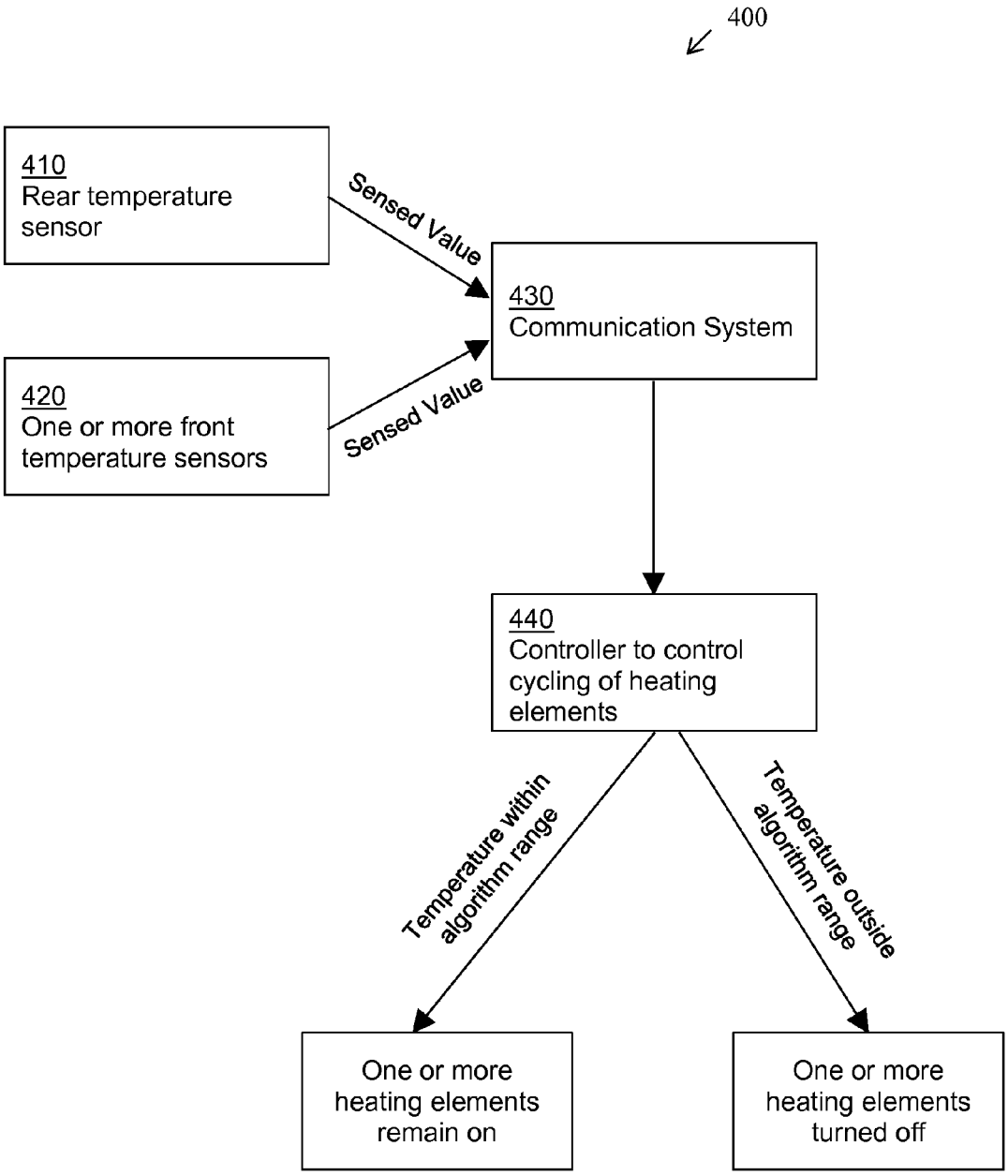
FIG. 4 shows how the temperature sensors communicate with a communication system and a controller.

As shown in the schematic information flow of FIG. 4, the system 400 may have a rear temperature sensor 410 that sends a sensed value to a communication system 430. One or more front temperature sensors 420 may send a sensed value to the communication system 430. The communication system 430 may then run an algorithm or formula or program that is delivered to the controller 440. The controller 440 then controls cycling of the heating elements (i.e., controls turning the heating elements remain on and/or off in order to achieve the desired optimal temperature value).

It is possible to create the algorithm so that the rear temperature sensor 410 is the master and the one or more front temperature sensors 420 are slaves. This results in the rear temperature sensor being the controlling factor in the equation, but being adjustable based on the values sensed by the slave sensors 420.

Changes and modifications, additions and deletions may be made to the structures and methods recited above and shown in the drawings without departing from the scope or spirit of the invention and the following claims.

What is claimed is:

1. An oven temperature control system for use in an oven comprising a cooking cavity, one or more heating elements, and a baffle plate, the cooking cavity on a front side of the baffle plate and the one or more heating elements on a rear side, behind the baffle plate, the oven temperature control system comprising:

(a) a rear temperature sensor positioned behind the baffle plate;

(b) one or more front temperature sensors positioned in front of the baffle plate;

(c) a communication system for receiving input from the rear temperature sensor and for receiving input from the one or more front temperature sensors in order to compare the inputs and determine an optimal shut-off value; and (d) a controller for controlling activation of the one or more heating elements upon receipt of instructions from the communication system.

2. The control system of claim 1, further comprising one or more additional front temperature sensors.

3. The control system of claim 1, wherein at least one of the one or more front temperature sensors is positioned at a front corner of the cooking cavity.

4. The control system of claim 1, wherein the rear temperature sensor is set to measure a temperature of an area adjacent to the one or more heating elements.

5. A method for controlling an oven temperature in an oven of claim 1, comprising:

(a) causing the rear temperature sensor to sense a first temperature behind the baffle plate;

(b) causing the one or more front temperature sensors to sense at least a second temperature in front of the oven baffle plate;

(c) sending the first and at least a second temperature to a communication system;

(d) comparing the temperatures and determining an optimal shut-off value;

(e) sending instructions from the communication system to a controller for controlling activation of the one or more heating elements upon receipt of instructions from the communication system.

* * * * *